US008350493B2

(12) United States Patent
Coley

(10) Patent No.: US 8,350,493 B2
(45) Date of Patent: Jan. 8, 2013

(54) ILLUMINATED PUSHBUTTON SWITCH WITH STEP DIMMING

(75) Inventor: Craig Jay Coley, Burleson, TX (US)

(73) Assignee: Aerospace Optics, Inc., Fort Worth, TX (US)

( * ) Notice: Subject to any disclaimer, the term of this patent is extended or adjusted under 35 U.S.C. 154(b) by 299 days.

(21) Appl. No.: 12/701,542

(22) Filed: Feb. 6, 2010

(65) Prior Publication Data

US 2010/0295469 A1 Nov. 25, 2010

Related U.S. Application Data

(60) Provisional application No. 61/206,969, filed on Feb. 6, 2009.

(51) Int. Cl.
*H05B 37/02* (2006.01)

(52) U.S. Cl. ..... 315/291; 315/294; 315/306

(58) Field of Classification Search ..... 315/119, 315/185 R, 287, 291, 294, 306
See application file for complete search history.

(56) References Cited

U.S. PATENT DOCUMENTS 2,926,346 A 2/1960 Smith et al.
4,888,589 A 12/1989 Bowers
5,939,839 A * 8/1999 Robel et al. ..... 315/289
6,670,776 B2 12/2003 Guthrie et al.
6,898,090 B2 5/2005 Nishida et al.
7,157,859 B2 * 1/2007 Inoue ..... 315/185 R
2005/0243491 A1 * 11/2005 Tanis ..... 361/104
2009/0273300 A1 * 11/2009 Kayser ..... 315/291
2010/0090614 A1 * 4/2010 Huang ..... 315/291

OTHER PUBLICATIONS

Notification of Transmittal of the International Search Report and the Written Opinion of the International Searching Authority, or the Declaration dated May 19, 2010 in connection with International Patent Application No. PCT/US10/23422.

* cited by examiner

*Primary Examiner* — Tung X Le

(57) ABSTRACT

A discrete dimming luminance control circuit for light emitting diode illumination includes first and second control inputs, a first supply circuit between the first control input and an output, a second supply circuit between the second control input and the output, a first shunt circuit between the second control input and the output, and a second shunt circuit between the first control input and the output. The luminance control circuit delivers a first voltage to the output when a supply voltage is applied to the first control input and the second control input is left open, a second voltage when the supply voltage is applied to the second control input and the first control input is left open, a third voltage when the supply voltage is applied to the first control input and the second control input is grounded, and a fourth voltage when the supply voltage is applied to the second control input and the first control input is grounded.

24 Claims, 4 Drawing Sheets

ILLUMINATED PUSHBUTTON SWITCH WITH STEP DIMMING

CROSS-REFERENCE TO RELATED APPLICATION(S) AND CLAIM OF PRIORITY

This application claims priority to commonly assigned U.S. Provisional Patent Application No. 61/206,969, filed Feb. 6, 2009, which is hereby incorporated by reference.

TECHNICAL FIELD

The present disclosure is directed, in general, to illuminated pushbuttons switches, and more specifically to implementing voltage-controlled discrete dimming for illuminated pushbutton switches.

BACKGROUND

Illuminated pushbutton switches and indicators utilized in modern avionics systems must operate over a wide range of ambient lighting environments, such as daylight, nighttime and even night vision goggle (NVG) conditions. Traditionally such illuminated switches and indicators used simple voltage control to vary the illumination intensity (or brightness) of the displays, with a different voltage being supplied to the display based upon the desired illumination level for the respective ambient lighting environment.

Unfortunately, many digital avionics systems do not have the capability to supply a varying (analog) voltage to alter the illumination of switches and indicators. Some digital avionics systems do incorporate pulse width modulation (PWM) capabilities, but the rapid and often narrow digital pulses used with this technique have been found to generate unacceptable levels of Electromagnetic Interference (EMI) or Radio Frequency Interference (RFI).

There is, therefore, a need in the art for improved voltage controlled dimming.

SUMMARY

A discrete dimming luminance control circuit for light emitting diode illumination includes first and second control inputs, a first supply circuit between the first control input and an output, a second supply circuit between the second control input and the output, a first shunt circuit between the second control input and the output, and a second shunt circuit between the first control input and the output. The luminance control circuit delivers a first voltage to the output when a supply voltage is applied to the first control input and the second control input is left open, a second voltage when the supply voltage is applied to the second control input and the first control input is left open, a third voltage when the supply voltage is applied to the first control input and the second control input is grounded, and a fourth voltage when the supply voltage is applied to the second control input and the first control input is grounded.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1A through 4, discussed below, and the various embodiments used to describe the principles of the present disclosure in this patent document are by way of illustration only and should not be construed in'any way to limit the scope of the disclosure. Those skilled in the art will understand that the principles of the present disclosure may be implemented in any suitably arranged system.

Figure 1A:
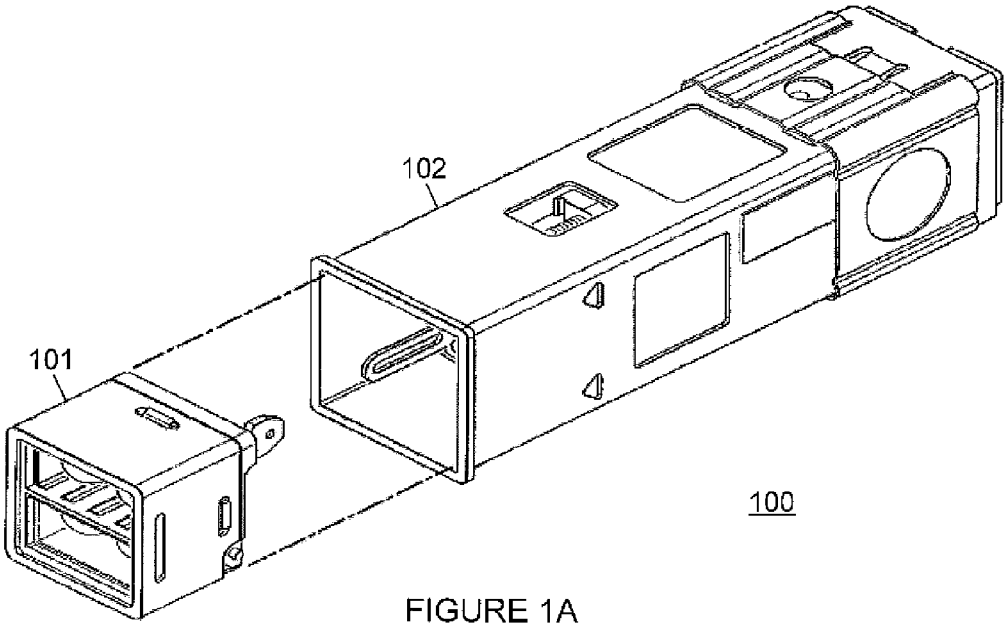
FIGS. 1A, 1B and 1C are exploded perspective views of a pushbutton illuminated switch (or components thereof) with discrete dimming according to one embodiment of the present disclosure.
Figure 1B:
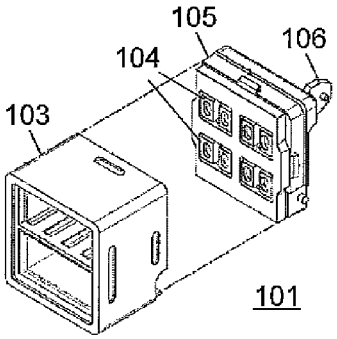
Figure 1C:
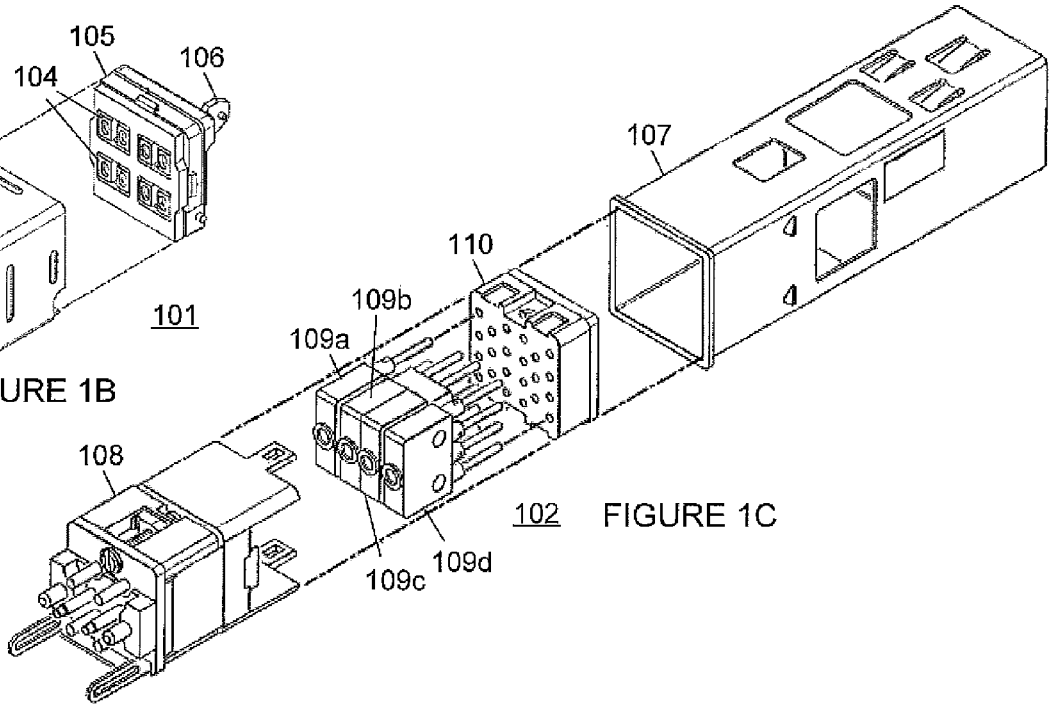

FIGS. 1A, 1B and 1C are exploded perspective views of a pushbutton illuminated switch (or components thereof) with discrete dimming according to one embodiment of the present disclosure. The pushbutton switch 100 includes a switch cap 101 and a switch body 102. The switch cap 101 is located at the front of the switch 100 and is received by the switch body 102. The switch cap 101 includes a switch cap housing 103 receiving an array 104 of surface mount diode (SMD) light emitting diodes (LEDs). The 2×4 LED array 104 in the exemplary embodiment has two rows of four LEDs arranged to illuminate four quadrants of a face plate (not shown) on the front of switch cap body 103, with two LEDs (a 1×2 subarray) per quadrant. The LEDs are mounted over a switch cap back plate 105 and are connected to an electrical driving circuit (not visible in FIG. 1B) mounted on the switch cap back plate 105. A member 106 for mechanical latching and release of the pushbutton switch when the switch cap 101 is depressed within the switch body 102 protrudes from the rear of switch cap back plate 105. Electrical connections (not shown) to the driving circuit are also exposed on the rear surface of switch cap back plate 105.

Switch body 102 includes a housing 107 receiving a mechanical and electrical subsystem 108 for mechanical latching and release of the pushbutton switch 100, for transmitting electrical signals to the driving circuit, and for transmitting mechanical forces to actuate four-pin snap-action switching devices 109*a* through 109*d*. Pins for the switching devices 109*a* through 109*d* are received by mounting block 110 and provide electrical switching by connections of the pins to external signal sources and/or through the subsystem 108 to the driving circuit. The pins of devices 109*a* through 109*d* extend through the mounting block 110 and may be connected at the rear of pushbutton switch 100 to external signals, to each other, and/or through subsystem 108 to the driving circuit.

Those skilled in the art will recognize that the complete structure and operation of a pushbutton switch of the type normally used in avionics is not depicted or described herein. Instead, for simplicity and clarity, only so much of the structure and operation of a pushbutton switch as is necessary for an understanding of the present disclosure is depicted and described. For example, filters between the LEDs and the switch cap face plate allow legends on the switch cap face plate to be illuminated in different colors as disclosed in U.S. Pat. No. 6,653,798, which is incorporated herein by reference. Numerous other features are also not depicted or described herein are or may be included within pushbutton switch 100.

Figure 2:
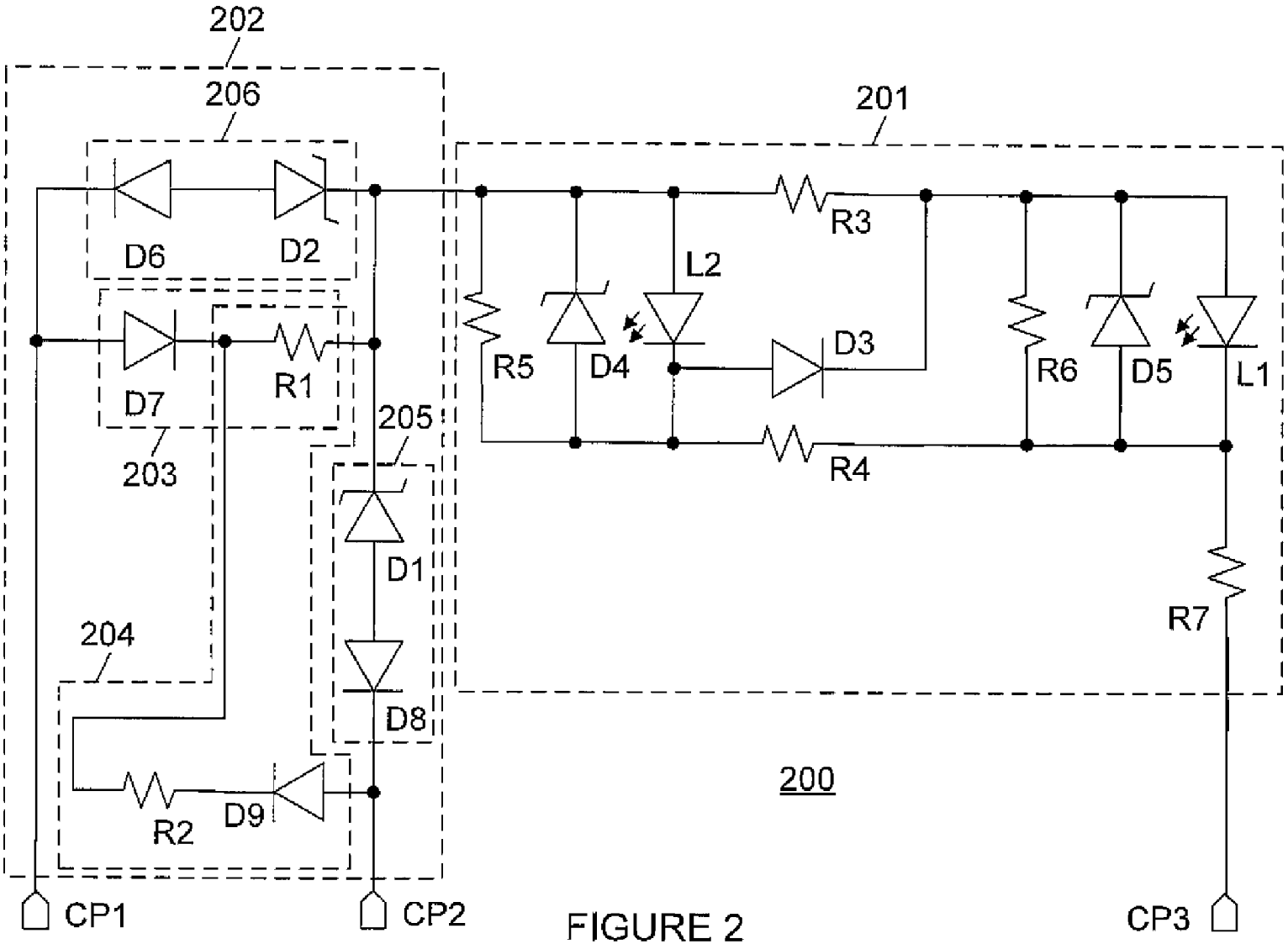
FIG. 2 is a circuit diagram for an LED driving circuit with discrete dimming according to one embodiment of the present disclosure.

FIG. 2 is a circuit diagram for an LED driving circuit with discrete dimming according to one embodiment of the present disclosure. The driving circuitry shown, and the alternate designs discussed below, is mounted on switch cap back plate 105 behind the LEDs. LED driving circuit 200 drives two LEDs, which are preferably disposed within the same, electrically isolated quadrant but which may alternatively be located within different quadrants. Accordingly, pushbutton switch 100 would include four identical instances of LED driving circuit 200, each instance driving two of the LEDs depicted in the example of FIGS. 1A-1C.

LED driving circuit 200 includes an LED illumination section 201 and a luminance control section 202. The LED illumination circuitry 201 employs series/parallel voltage-controlled dimming circuitry of the type described in U.S. Pat. No. 6,323,598, combined with the improved quiescent current circuitry described in U.S. Patent Application Publication No. 2009/0261745. In addition, the fault tolerance scheme of U.S. Pat. No. 6,650,064 and the technique of using filtered white LEDs to produce multiple colors as taught in U.S. Pat. No. 6,653,798 are also employed. Each of the above-identified patent documents is incorporated herein by reference.

LED illumination circuitry 201 includes two LEDs L1 and L2 that are switched between series and parallel connection by resistors R3, R4, R5 and R6 and switching diode D3. The anode of each LED L1 and L2 is connected to a terminal of resistor R3, while the cathode of each LED L1 and L2 is connected to a terminal of resistor R4, with resistors R3 and R4 separating the electrical nodes to which LEDs L1 and L2 are connected. Resistor R6 is connected in parallel with LED L1 and resistor R5 is connected in parallel with LED L2. Switching diode D2 is connected at the anode to the cathode of LED 12 and at the cathode to the anode of LED L1.

Resistors R5 and R6 each have a resistance of 2.5 kilo-Ohms (KΩ), while resistors R3 and R4 each have a resistance of 10 KΩ. Resistors R5 and R6 in particular are preferably ceramic chip resistors that may be laser trimmed to adjust the resistance and make LEDs L1 and L2 emit with uniform luminance. Quiescent current limiting zener diodes D4 and D5 are connected in parallel with LEDs L2 and L1, respectively, with reverse orientation (i.e., the anode of diodes D4 and D5 are connected to the cathode of LED L2 or L1 and the cathode of diodes D4 and D5 are connected to the anode of LED L2 or L1). As described in the above-identified patent documents, varying the values of resistors R3, R4, R5 and R6 alters the quiescent current value, the series-to-parallel switchover voltage and the shape of the voltage dimming curve (as a function of the voltage applied to the anode of LED L2). A 510Ω resistor R7 is connected between the cathode of LED L1 and a control pin CP3, which will normally be grounded.

Luminance control circuitry 202 implements discrete dimming by altering the voltage supplied to the anode of LED 12 within the LED illumination circuitry 201 depending on the voltages applied to control pins CP1 and CP2. A first supply circuit 203 connects control pin CP1 to the output (the node connected to the input of LED illumination circuitry 201 at the anode of LED L2), and delivers a first voltage to the output when power is applied to control pin CP1 and control pin CP2 is left open (floating). A second supply circuit 204 connects control pin CP2 to the output and delivers a second voltage to the output when power is applied to control pin CP2 and control pin CP1 is left open. A first shunt circuit 205 is connected between control pin CP2 and the output of luminance control circuitry 202, voltage limiting the power supplied to the output to a third voltage when power is applied to control pin CP1 and control pin CP2 is grounded. A second shunt circuit 206 is connected between control pin CP1 and the output, voltage limiting the power supplied to the output to a fourth voltage when power is applied to control pin CP2 and control pin CP1 is grounded.

In the exemplary embodiment of luminance control circuitry 202, control pin CP1 is connected to the cathode of switching diode D6 and to the anode of switching diode D7. The anode of switching diode D6 is connected to the anode of zener diode D2, and the cathode of zener diode D2 is connected to the input to the LED illumination circuitry 201 (i.e., the node connected to the anode of LED L2). Switching diode D7 and resistor R1 are connected in parallel with switching diode D6 and zener diode D2 between control pin CP1 and the input to LED illumination circuitry 201. Control pin CP1 is connected to the anode of switching diode D7. Resistor R1 is connected between the cathode of switching diode D7 and the cathode of zener diode D2, and has a resistance of 1,400Ω.

Control pin CP2 is connected to the cathode of switching diode D8 and to the anode of switching diode D9. The anode of switching diode D8 is connected to the anode of zener diode D1, and the cathode of zener diode D1 is connected to the input to the LED illumination circuitry 201. The cathode of switching diode D9 is connected to resistor R2. The other terminal of resistor R2 is connected to the cathode of switching diode D7. Resistor R2 has a resistance of 6 KΩ.

In operation, +28 volts (V) of direct current (DC) power and ground are selectively applied under external control (e.g., by digital control avionics, not shown) to control pins CP1 and CP2 in order to reduce the display luminance from a default high luminance state to one of three lower luminance states. TABLE I below contains the control voltage settings and corresponding luminance output levels:

TABLE I

| Control Pin | | Luminance | | |
|---|---|---|---|---|
| CP1 | CP2 | Mode | Level | Percent |
| +28 V | Open | Daylight | 300 fl | 100% |
| Open | +28 V | Shelter | 50 fl | 17% |

TABLE I-continued

| Control Pin | | Luminance | | |
|---|---|---|---|---|
| CP1 | CP2 | Mode | Level | Percent |
| +28 V | Ground | Night | 10 fl | 3% |
| Ground | +28 V | NVIS | 1 fl | 0.3% |

In the default high luminance daylight (sunlight readable) mode, +28 VDC of power, is applied to CP1 of luminance control circuitry 202, while control pin CP2 is left open (floating). Operating current is thus supplied from control pin CP1 through switching diode D7 and resistor R1 to the input to LED illumination circuitry 201. Switching diode D6 prevents current from flowing through the shunt path formed by zener diode D2 and switching diode D6. In this mode, the LED illumination circuitry 201 operates in the power efficient series connection (of LEDs L1 and L2) configuration and will respond to voltage controlled dimming as described in the above-identified patent documents. The daylight luminance setting corresponds to output by the LEDs L1 and L2 of approximately 300 foot-lamberts (fl) and is designed for application requiring display readability in direct sunlight.

To operate in lower luminance shelter mode, +28 VDC is supplied to control pin CP2 and control pin CP1 is left open. Operating current is then supplied from control pin CP2 through switching diode D9 and resistors R2 and R1 to the input to LED illumination circuitry 201. Switching diode D8 prevents current from flowing through the shunt path formed by zener diode D1 and switching diode D8. Because of the much higher series resistance, the LED illumination circuitry 201 will operate at a substantially reduced luminance level but still in the power efficient series connection configuration, and will still respond to voltage controlled dimming. The shelter luminance setting corresponds to output by the LEDs L1 and L2 of approximately 50 fl and is designed for applications such as shipboard control consoles that do not require readability in direct sunlight but still require a degree of luminance variability.

To operate in the still lower luminance night mode, +28 VDC is supplied to control pin CP1 and control pin CP2 is grounded. In this mode, operating current flows through switching diode D7 and resistor R1 to the input to LED illumination circuitry 201 as in daylight mode, but is shunt regulated by zener diode D1 and switching diode D8, effectively reducing the voltage applied to the input of the LED illumination circuitry 201. In addition to reducing the applied voltage, the regulator circuit (zener diode D1 and switching diode D8) stabilizes the applied input voltage such that input voltage variations will have minimal effect on display luminance. Switching diode D8 further provides a negative temperature coefficient to offset the positive temperature coefficient of zener diode D1, thereby also stabilizing the display luminance over temperature variations. The night luminance setting corresponds to output by the LEDs L1 and L2 of approximately 10 fl and is designed for applications such as aircraft nighttime operations requiring luminance consistency despite a varying input voltage.

To operate in the lowest luminance night vision imaging system (NVIS) mode, +28 VDC is supplied to control pin CP2 and control pin CP1 is grounded. In this mode, operating current flows through switching diode D9 and resistors R2 and R1 to the input to LED illumination circuitry 201 as in shelter mode, but is shunt regulated by zener diode D2 and switching diode D6, effectively reducing the voltage applied to the input of the LED illumination circuitry 201. In addition to reducing the applied voltage, the regulator circuit (zener diode D2 and switching diode D6) stabilizes the applied input voltage such that input voltage variations have minimal effect on display luminance. Switching diode D6 provides a negative temperature coefficient to offset the positive temperature coefficient of zener diode D2, stabilizing the display luminance over temperature variations. The NVIS luminance setting corresponds to output by the LEDs L1 and L2 of approximately 1 fl and is designed for aircraft operation with night vision goggles (NVGs), where luminance consistency despite a varying input voltage is required.

The inherent voltage regulation characteristics of the night and NVIS modes not only establish a corresponding preset reduced luminance state, but also provide tolerance to input voltage fluctuations on the +28 VDC power supply. Such voltage and luminance regulation is important when the display encounters a reduced voltage condition resulting from a generator failure, auxiliary power unit (APU) switchover, or engine startup sequence.

While the exemplary luminance settings and component values described above are typical of many avionics applications, the regulation voltages (and therefore the display luminance) can be set to almost any level. Different resistances for resistors R1 and R2 (relative to resistors R3, R4, R5 and R6) will result in different input voltages being applied to the input of LED illumination circuitry 201 in daylight and shelter modes, and therefore different output luminance by LEDs L1 and L2. By simply selecting zener diodes D1 and D2 with an appropriate regulation voltage, higher or lower luminance levels can be selected for night and NVIS modes. With four electrically independent quadrant circuits, the component values of individual quadrant circuits can be modified to tailor the display luminance at each selected level, depending for example on filter characteristics. Notably, the ability to customize luminance is particularly important if simple advisory information is presented on the same display face as caution or warning information, since military and civilian lighting specifications both require a different nighttime luminance level for caution and warning signals as opposed to simple advisory signals.

For example, a display for a particular pushbutton switch may be divided into two halves (two quadrants per half), with the top half using an illuminated bright visible type legend denoting function and the bottom half using a sunlight readable type legend denoting status, where a nearly 4:1 difference exists in visibility between the two legend types (due to the reflectivity of the bright visible type legend lettering, which is sufficient to ensure readability in daylight conditions). In that case, the bright visible type legend only needs illumination to facilitate visibility of legend information at night, and thus is visible in daylight conditions with much less backlighting illumination. Two quadrant circuits may thus be designed to meet bright visible luminance requirements and the remaining two for sunlight readability. In particular, the zener diodes D1 and D2 are selected to operate at a higher voltage for the bright visible type legend, so that both legends operate at the same luminance levels in night and NVIS modes (e.g., each at 10 fl for night mode and 1 fl for NVIS mode) despite operating at widely differing luminance levels in daylight mode (e.g., 100 fl for the bright visible type legend versus 300 fl for the sunlight readable type legend).

Figure 3:
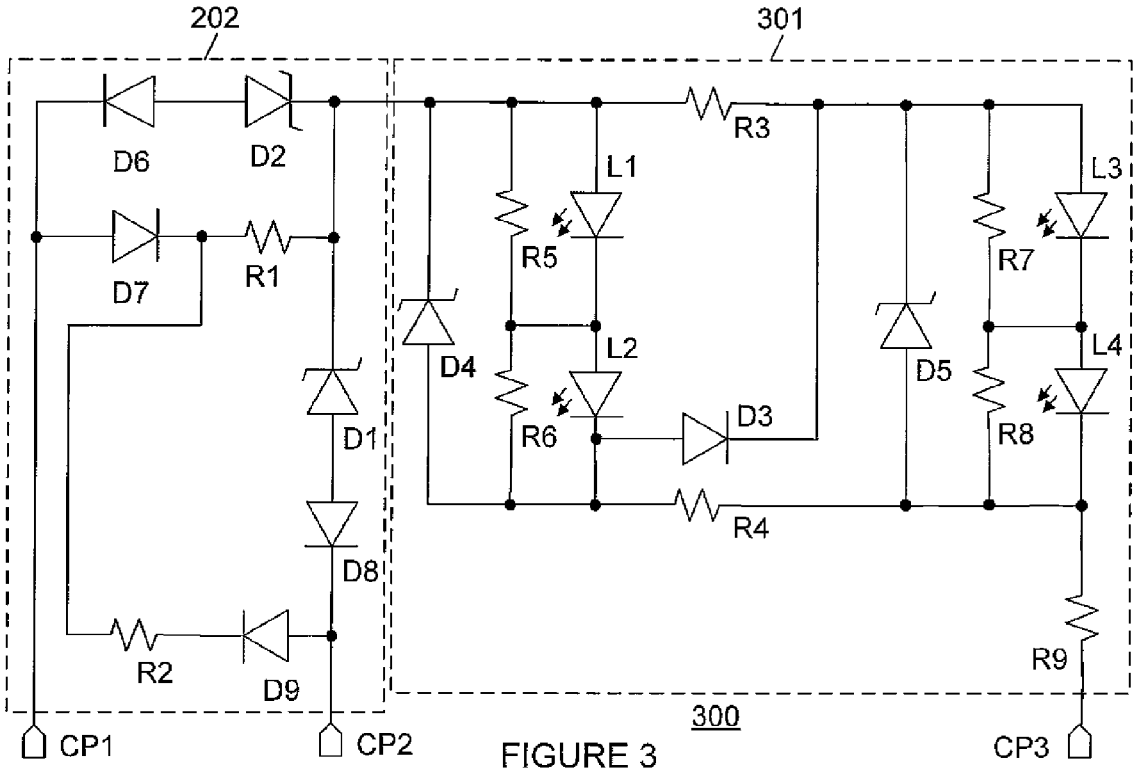
FIG. 3 is a circuit diagram for an LED driving circuit with discrete dimming according to another embodiment of the present disclosure.
Figure 4:
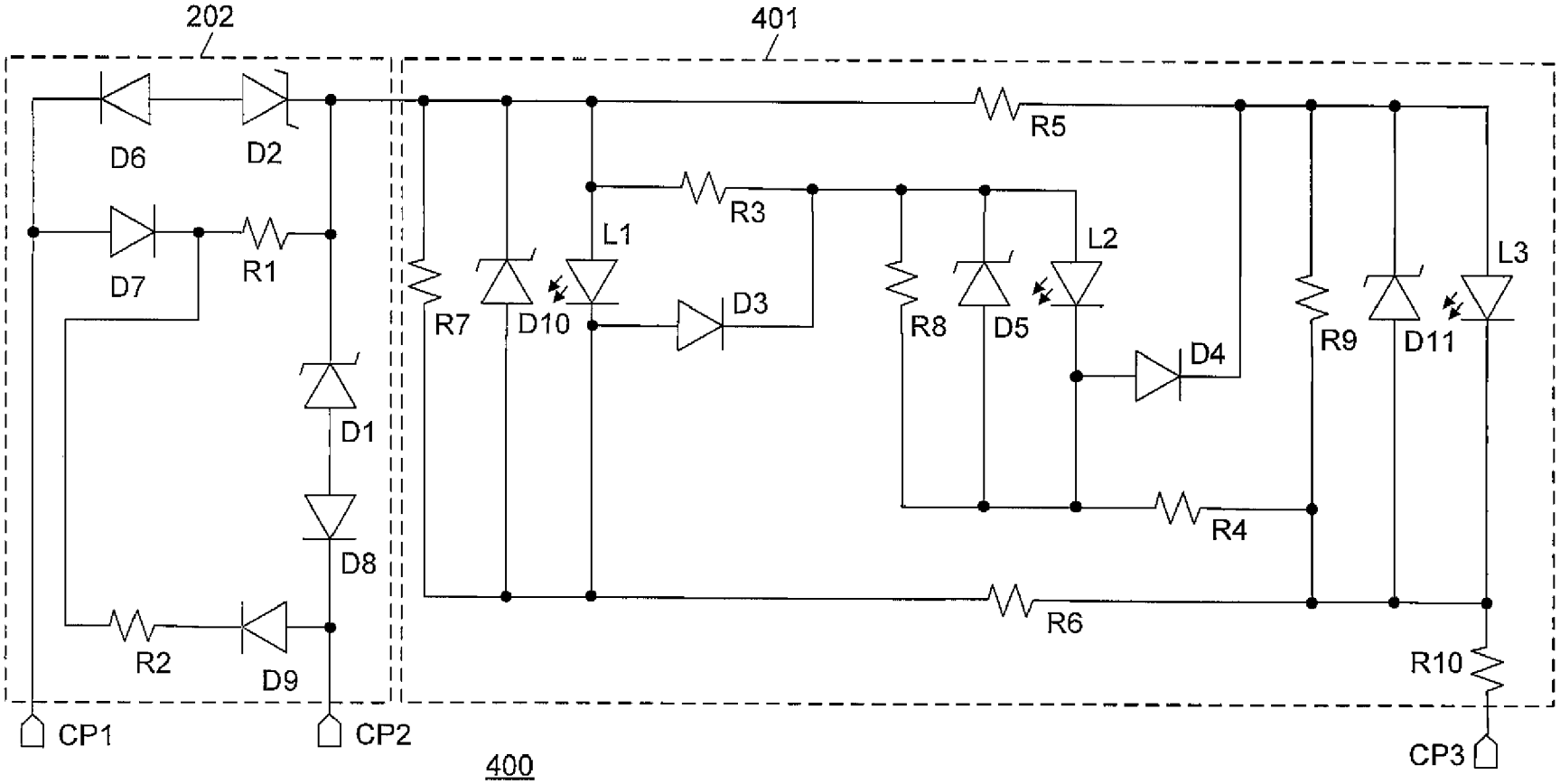
FIG. 4 is a circuit diagram for an LED driving circuit with discrete dimming according to yet another embodiment of the present disclosure.

FIGS. 3 and 4 are a circuit diagrams for an LED, driving circuit with discrete dimming according to other embodiments of the present disclosure. The circuits of either FIG. 3 or FIG. 4 may be used in place of the circuit in FIG. 2 within switch 100 to achieve comparable performance. The most significant difference between the embodiments of FIGS. 3 and 4 and the embodiment of FIG. 2 are the number of LEDs within the LED illumination circuit, since the circuit of FIG. 2 is designed to illuminate small displays while circuits of FIGS. 3 and 4 are designed to illuminate intermediate and larger format displays, respectively.

LED illumination circuit 301 within the LED driving circuit 300 of FIG. 3 includes four LEDs L1, L2, L3 and L4, with LEDs L1 and L2 connected in series and LEDs L3 and L4 connected in series. LED illumination circuit 301 may thus be employed as a quadrant circuit driving a 2×2 sub-array of LEDs within a 4×4 array. Resistors R5, R6, R7 and R8 are each connected in parallel across LEDs L1, L2, L3 and L4, respectively, and each have a resistance of 15 KΩ in the example of FIG. 3. Resistors R3 and R4 are connected between the anodes of LEDs L1 and L3 and between the cathodes of LEDs L2 and L4, respectively, and each have a resistance of 8.3 KΩ in the example of FIG. 3. Switching diode D3 is connected at the anode to the cathode of LED L2 and at the cathode to the anode of LED L3. Zener diode D4 is connected between the anode of LED L1 and the cathode of LED L2, while zener diode D5 is connected between the anode of LED L3 and the cathode of LED L4. Resistor R9 is connected between control pin CP3 and the cathode of LED L4, and has a resistance of 470Ω in the example of FIG. 3. Luminance control circuitry 202 within the LED driving circuit 300 of FIG. 3 is connected to the input of LED illumination circuit 301, at the anode of LED L2. Luminance control circuitry 202 has the same configuration as depicted in FIG. 2, and only the value of resistor R1 needs to be changed, to 900Ω, to achieve the functionality set forth above in TABLE I.

LED illumination circuit 401 within the LED driving circuit 400 of FIG. 4 includes three LEDs L1, L2 and L3 that are switched between series and parallel connection. LED illumination circuit 401 may thus be employed to drive a row (or column) of three LEDs within a 4×6 or 6×6 array. Resistor R5 is connected between the anodes of LEDs L1 and L3, and resistor R6 is connected between the cathodes of LEDs L1 and L3, with both resistors R5 and R6 having a resistance of 10 KΩ. Resistor R7 and zener diode D10 are connected in parallel across LED L1; resistor R8 and zener diode D5 are connected in parallel across LED L2; and resistor R9 and zener diode D11 are connected in parallel across LED L3. Resistors R7, R8 and R9 each have a resistance of 6.8 KΩ. Resistor R3 is connected between the anodes of LEDs L1 and L2, while resistor R4 is connected between the cathodes of LEDs L2 and L3, with each of resistors R3 and R4 having a resistance of 5 KΩ. Switching diode D3 is connected at the anode to the cathode of LED L1 and at the cathode to the anode of LED L2. Switching diode D4 is connected at the anode to the cathode of LED L2 and at the cathode to the anode of LED L3. Resistor R10 is connected between control pin CP3 and the cathode of LED L3, and has a resistance of 510Ω in the example of FIG. 4. Luminance control circuitry 202 within the LED driving circuit 400 of FIG. 4 has the same configuration as in FIG. 2, with the same values as described above in connection with FIG. 2 achieving the functionality of TABLE I.

Each of the embodiments described above uses only passive circuit components (diodes and resistors, no transistors) to selectively vary the voltage applied to the LED illumination circuit 200, 300 or 400. Because no active circuit components are employed, the Federal Aviation Administration's costly and rigid requirements for airframe manufacturers using application specific integrated circuits (ASICs) or other programmable integrated circuits are not applicable. In addition, passive circuitry within flight critical equipment is understood to provide better tolerance to electromagnetic interference, and does not require electromagnetic shielding.

The present disclosure employs analog shunt voltage regulation to provide multiple levels of display illumination using available digital control outputs typical in digital avionics systems. The technique disclosed is highly reliable and provides temperature compensation to minimize LED luminance variances with ambient temperature. Two regulatory and safety related concerns are also solved: Only passive components with no transistors, logic circuits or ASICs are used, avoiding most regulatory issues. The design defaults to a high luminance state in the event of a wiring or avionics failure, answering most flight safety concerns. Each of the designs disclosed provides four externally selectable reduced luminance steps, chosen by selective application of power and ground to external pins. In addition to such external switch selectable step dimming, each of the designs retains voltage controlled dimming capabilities (through the daylight setting) for appropriate applications.

Although the above description is made in connection with specific exemplary embodiments, various changes and modifications will be apparent to and/or suggested by the present disclosure to those skilled in the art. It is intended that the present disclosure encompass all such changes and modifications as fall within the scope of the appended claims.

What is claimed is:

1. A discrete dimming luminance control circuit for light emitting diode illumination, comprising:

first and second control inputs;

a first supply circuit between the second control input and an output; and a first shunt controlled voltage regulator between the second control input and the output, wherein the luminance control circuit delivers, to the output, a first voltage when a supply voltage is applied to the first control input and the second control input is either left open or grounded, and a second voltage different than the first voltage when the supply voltage is applied to the second control input and the first control input is either left open or grounded.

2. The luminance control circuit of claim 1, further comprising:

a second supply circuit between the first control input and the output; and a second shunt controlled voltage regulator between the first control input and the output, wherein the luminance control circuit delivers, to the output, the first voltage when the supply voltage is applied to the first control input and the second control input is left open, and the second voltage when the supply voltage is applied to the second control input and the first control input is either left open or grounded, and a third voltage different than the first and second voltages when the supply voltage is applied to the first control input and the second control input is grounded.

3. The luminance control circuit of claim 2, wherein the luminance control circuit delivers, to the output, the second voltage when the supply voltage is applied to the second control input and the first control input is left open, and a fourth voltage different than the first, second and third voltages when the supply voltage is applied to the second control input and the first control input is grounded.

4. The luminance control circuit of claim 3, wherein the first supply circuit comprises a first switching diode in series with a first resistor connected between the first control input and the output, the second supply circuit comprises a second switching diode in series with a second resistor connected between the second control input and the first resistor, the first shunt circuit comprises a third switching diode in series with a first zener diode connected between the second control input and the output, and the second shunt circuit comprises a fourth switching diode in series with a second zener diode connected between the first control input and the output.

5. The luminance control circuit of claim 4, wherein the luminance control circuit delivers the first voltage through the first switching diode and the first resistor.

6. The luminance control circuit of claim 4, wherein the luminance control circuit delivers the second voltage through the second switching diode, the second resistor and the first resistor.

7. The luminance control circuit of claim 4, wherein the luminance control circuit delivers the third voltage through first switching diode and the first resistor, voltage limited by the third switching diode and the first zener diode.

8. The luminance control circuit of claim 4, wherein the luminance control circuit delivers the fourth voltage through the second switching diode, the second resistor and the first resistor, voltage limited by the fourth switching diode and the second zener diode.

9. The luminance control circuit of claim 4, wherein the first voltage is greater than the second voltage, the second voltage is greater than the third voltage, and the third voltage is greater than the fourth voltage.

10. A light emitting diode illumination system including the luminance control circuit of claim 4, the illumination system further comprising:

first and second light emitting diode (LED) groups coupled to the output of the luminance control circuit, wherein the luminance control circuit delivers, to the output, a variable voltage between at least some of the first, second, third and fourth voltages to provide voltage-controlled dimming of an output of LEDs within the first and second light emitting diode groups.

11. The illumination system of claim 10, wherein the luminance control circuit delivers variable voltages between the first and second voltages and between the second and third voltages.

12. The illumination system of claim 10, further comprising:

a switching circuit switching the first and second light emitting diode groups between series and parallel connection in response to changes in the variable voltage.

13. A method of discrete dimming light emitting diode illumination using a circuit including first and second control inputs, a first supply circuit between the second control input and an output, and a first shunt controlled voltage regulator between the second control input and the output, the method comprising:

delivering a first voltage to the output when a supply voltage is applied to the first control input and the second control input is either left open or grounded; and delivering a second voltage different than the first voltage to the output when the supply voltage is applied to the second control input and the first control input is either left open or grounded.

14. The method of claim 13, the circuit further including a second supply circuit between the first control input and the output and a second shunt controlled voltage regulator between the first control input and the output, the method further comprising:

delivering a third voltage different than the first and second voltages to the output when the supply voltage is applied to the first control input and the second control input is grounded.

15. The method of claim 14, further comprising:

delivering a fourth voltage different than the first, second and third voltages to the output when the supply voltage is applied to the second control input and the first control input is grounded.

16. The method of claim 14, wherein the first supply circuit comprises a first switching diode in series with a first resistor connected between the first control input and the output, the second supply circuit comprises a second switching diode in series with a second resistor connected between the second control input and the first resistor, the first shunt circuit comprises a third switching diode in series with a first zener diode connected between the second control input and the output, and the second shunt circuit comprises a fourth switching diode in series with a second zener diode connected between the first control input and the output.

17. The method of claim 16, further comprising:

delivering the first voltage through the first switching diode and the first resistor.

18. The method of claim 16, further comprising:

delivering the second voltage through the second switching diode, the second resistor and the first resistor.

19. The method of claim 18, further comprising:

delivering the third voltage through first switching diode and the first resistor, voltage limited by the third switching diode and the first zener diode.

20. The method of claim 18, further comprising:

delivering the fourth voltage through the second switching diode, the second resistor and the first resistor, voltage limited by the fourth switching diode and the second zener diode.

21. The method of claim 16, wherein the circuit includes first and second light emitting diode (LED) groups coupled to the output of the luminance control circuit, the method further comprising:

delivering to the output a variable voltage between at least some of the first, second, third and fourth voltages to provide voltage-controlled dimming of an output of LEDs within the first and second light emitting diode groups.

22. The method of claim 21, further comprising:

delivering variable voltages between the first and second voltages and between the second and third voltages.

23. The method of claim 21, further comprising:

switching the first and second light emitting diode groups between series and parallel connection in response to changes in the variable voltage.

24. The method of claim 16, wherein the first voltage is greater than the second voltage, the second voltage is greater than the third voltage, and the third voltage is greater than the fourth voltage.

* * * * *